US006457716B1

(12) United States Patent
Johnson Prillerman

(10) Patent No.: US 6,457,716 B1
(45) Date of Patent: Oct. 1, 2002

(54) CARD GAME HAVING CARDS WITH GRAPHIC AND PICTORIAL ILLUSTRATIONS OF GEOGRAPHIC, HISTORICAL AND HEALTH RELATED FACTS

(76) Inventor: Kathleen O. Johnson Prillerman, 1341 N. 58th St., Philadelphia, PA (US) 19131

( * ) Notice: Subject to any disclaimer, the term of this patent is extended or adjusted under 35 U.S.C. 154(b) by 0 days.

(21) Appl. No.: 09/415,478

(22) Filed: Oct. 9, 1999

(51) Int. Cl.[7] ..... A63F 1/00

(52) U.S. Cl. ..... 273/296; 273/302; 273/308; 273/292

(58) Field of Search ..... 273/296, 302, 273/308, 429–432, 236, 242, 243, 249–254

(56) References Cited

U.S. PATENT DOCUMENTS 1,745,946 A * 2/1930 Murray ..... 273/296
4,824,119 A 4/1989 Matthews ..... 273/308
5,123,846 A 6/1992 Lewis ..... 434/130
5,141,335 A 8/1992 Hernandez ..... 273/308
5,205,563 A 4/1993 Dearing ..... 273/296
5,405,140 A 4/1995 Terlinden et al. ..... 273/251
5,632,488 A 5/1997 Sturm et al. ..... 273/293

* cited by examiner

*Primary Examiner*—Benjamin H. Layno
(74) *Attorney, Agent, or Firm*—Susan B. Evans

(57) ABSTRACT

Disclosed herein are card games which utilize a plurality of playing cards to explore geography, history and health. These card games are particularly used for educational purposes as it relates specifically to Oceans, Continents, Great Lakes, States and State Capitals, African American Inventors and Inventions, Truth Fact Match , and African Nations and Capitals and Wellness Match. These cards provide both graphic and pictorial expression of geographic and historical facts.

18 Claims, 3 Drawing Sheets

FIG. 1
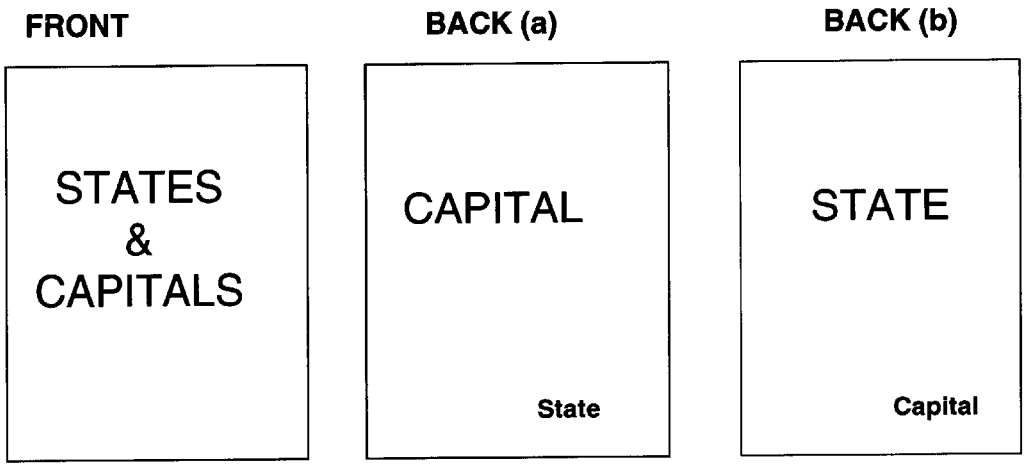
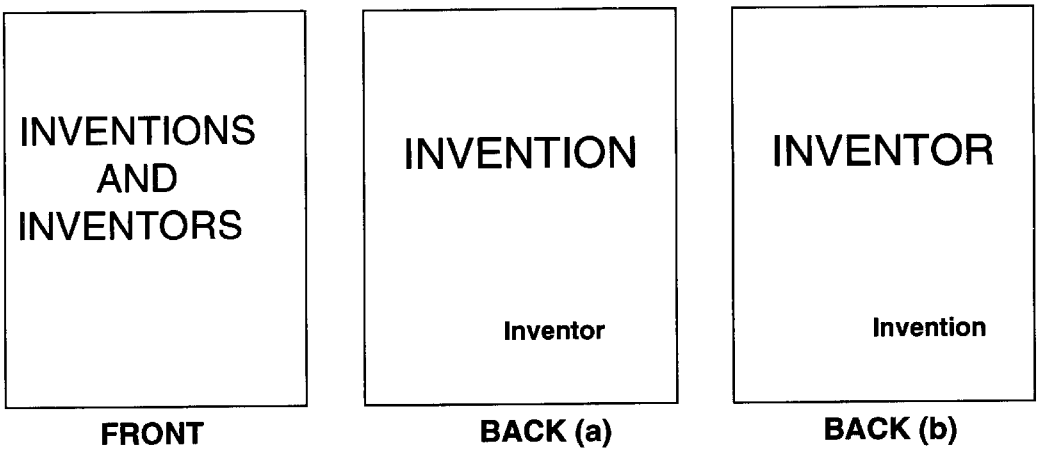
FIG. 2

FIG. 3
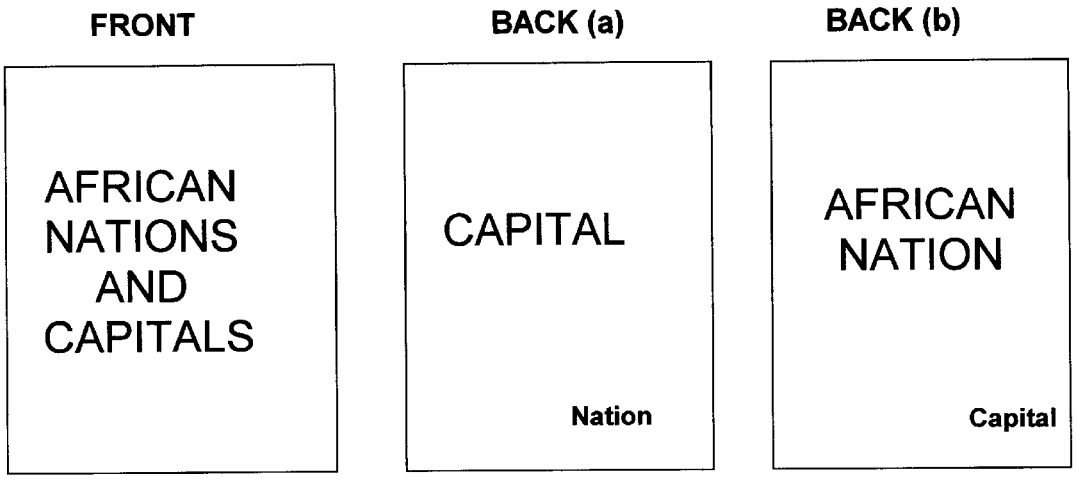
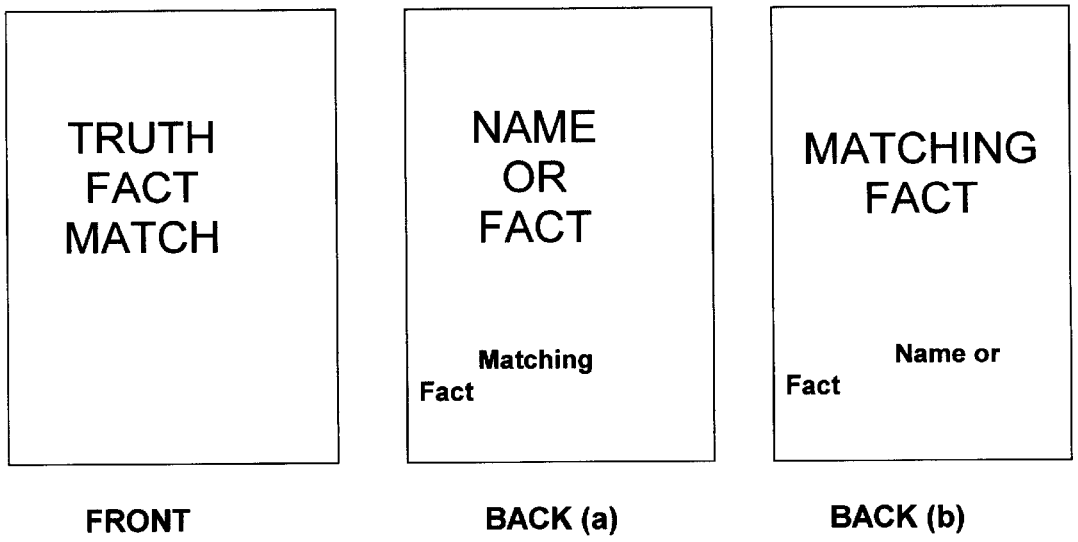
FIG. 4

CARD GAME HAVING CARDS WITH GRAPHIC AND PICTORIAL ILLUSTRATIONS OF GEOGRAPHIC, HISTORICAL AND HEALTH RELATED FACTS

BACKGROUND

The present invention relates to geography, history and health related card games and playing cards, particularly as used for educational purposes as it relates specifically to Oceans, Great Lakes, Continents, States and State Capitals, African American Inventors and Inventions, Truth Fact Match, African Nations and Capitals, and Wellness Match.

This game, which is equally enjoyed by adults and children, provides not only entertainment but also provides an opportunity to educate participants particularly young people using intellectual stimuli and gamesmanship. It takes subject matter (geography, history and health) that may be considered boring or tedious and makes it fun and exciting.

A preliminary search by the inventor failed to disclose the card games of the present invention.

The following is a listing of the patents discovered during the aforementioned search:

| U.S. PAT. No. | PATENTEE | DATE |
|---|---|---|
| U.S. Pat. No. 5,632,488 | Sturm et al. | 5/27/97 |
| U.S. Pat. No. 5,405,140 | Terlinden et al. | 4/11/95 |
| U.S. Pat. No. 5,205,563 | Dearing | 4/27/93 |
| U.S. Pat. No. 5,141,235 | Hernandez | 8/25/92 |
| U.S. Pat. No. 5,123,846 | Lewis | 6/23/92 |
| U.S. Pat. No. 4,824,119 | Matthews | 4/25/89 |

Card games that entertain and educate are known for a variety of subjects as, for example, Political Figures (U.S. Pat. No. 5,632,488) and US Geography (U.S. Pat. No. 5,405,140). Further, a Card game with back spelled names of states is known in the art (U.S. Pat. No. 4,824,119).

SUMMARY OF THE INVENTION

The present invention provides card games with game cards depicting oceans, great lakes, continents, states and state capitals, African American inventors and inventions, Truth Fact Match, African Nations and Capitals, and Wellness Match The game includes game cards which are organized in one or more decks of 90, 93, 100, 106 or 109 game cards. Each deck consists of Game Cards which are further identified as either Playing Cards or Action Cards. Each Playing Card has a color coded border, as well as indicia, both graphic and pictorial, depicting oceans (Atlantic, Pacific, Indian, Antarctica and Arctic) (93 cards); great lakes (Huron, Ontario, Michigan, Erie, Superior) (93 cards); continents (Africa, Antarctica, Asia, Australia, Europe, North America and South America) (90 cards); or States of the United States and Their Capitals (100 cards); Inventors and Inventions (100 cards); Truth Fact Match (92 cards); African Nations and Capitals (106); and Wellness Match (90).

Action Cards are an integral part of the Oceans, Great Lakes and Continents games. They are a part of each deck of Game Cards and the play of the game. Action cards with color coded borders direct a beneficial or a detrimental action to be taken by the player drawing an Action Card.

BRIEF DESCRIPTION OF THE DRAWINGS

These as well as other features of the present invention will become more apparent upon reference to the drawings wherein:

FIGS. 1 (*a*) & (*b*) is a view of the front and rear faces of a Playing Card used in the play of the States and Capitals aspect of the present game.

FIGS. 2 (*a*) & (*b*) is a view of the front and rear faces of a Playing Card used in the play of the African American Inventions and Inventors aspects of the present game.

FIGS. 3 (*a*) & (*b*) is a view of the front and rear faces of a Playing Card used in the play of the African Nations and Capitals aspect of the present game.

FIGS. 4 (*a*) & (*b*) is a view of the front and rear faces of a Playing Card used in the play of Truth Fact Match aspect of the present game.

DETAILED DESCRIPTION OF THE INVENTION

Figure 5:
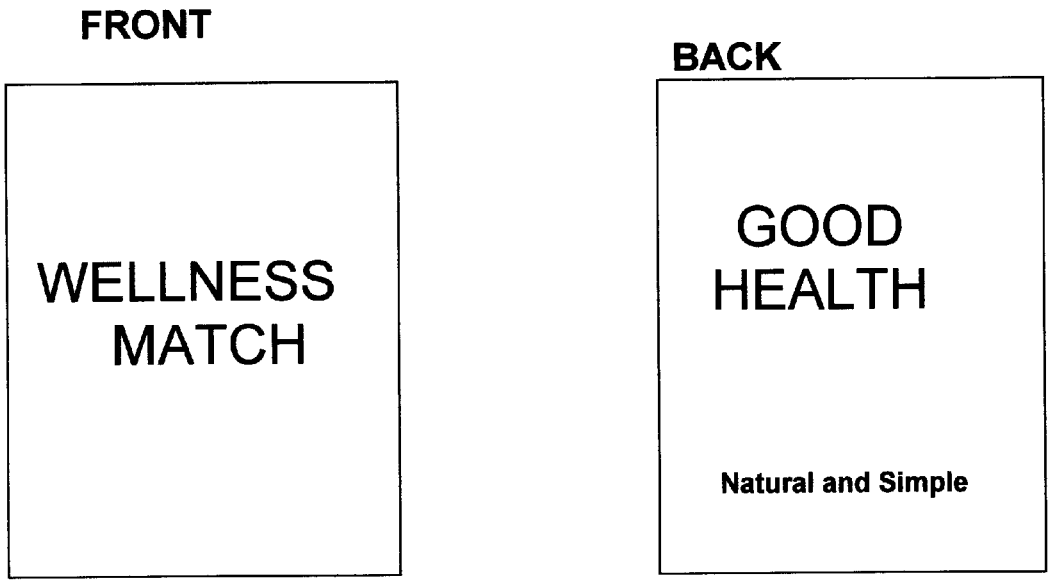
FIGS. 5 (*a*) & (*b*) is a view of the front and rear faces of a Playing Card used in the play of the Wellness Match aspect of the present game.

Referring to the drawings, the present invention will be seen to relate to a card game(s) that provides Game Cards consisting of Playing Cards with a color coded border and Action Cards.

Playing Cards depict States and States Capitols (FIGS. 1,*a,b*), African American Inventors and Inventions (FIGS. 2,*a,b*), African Nation and Capitals (FIGS. 3,*a,b*), Truth Fact Match (FIGS. 4,*a,b*), and a Wellness Match (FIG.5).

OPERATION OF THE GAME

The directions for playing the various forms of the games are as follows:

STATES AND CAPITALS

The deck contains 100 game cards as follows:

50 Playing Cards with the name of each state listed (capitals listed on the bottom in fine print)

50 Playing Cards with the state capitals listed (states listed on the bottom in fine print)

States and Capitals may be played by both adults and children as young as the age of six years with 2–10 players. The object of the game is to be the first player to get rid of all cards in players hand.

The play of the game is as follows: The states and capitals are selected from the following:

| STATES | CAPITALS |
|---|---|
| Alabama | Montgomery |
| Alaska | Juneau |
| Arizona | Phoenix |
| Arkansas | Little Rock |
| California | Sacramento |
| Colorado | Denver |
| Connecticut | Hartford |
| Delaware | Dover |
| Florida | Tallahassee |
| Georgia | Atlanta |
| Hawaii | Honolulu |
| Idaho | Boise |
| Illinois | Springfield |
| Indiana | Indianapolis |
| Iowa | Des Moines |
| Kansas | Topeka |
| Kentucky | Frankfort |
| Louisiana | Baton Rouge |
| Maine | Augusta |
| Maryland | Annapolis |

-continued

| STATES | CAPITALS |
|---|---|
| Massachusetts | Boston |
| Michigan | Lansing |
| Minnesota | St. Paul |
| Mississippi | Jackson |
| Missouri | Jefferson City |
| Montana | Helena |
| Nebraska | Lincoln |
| Nevada | Carson City |
| New Hampshire | Concord |
| New Jersey | Trenton |
| New Mexico | Santa Fe |
| New York | Albany |
| North Carolina | Raleigh |
| North Dakota | Bismarck |
| Ohio | Columbus |
| Oklahoma | Oklahoma City |
| Oregon | Salem |
| Pennsylvania | Harrisburg |
| Rhode Island | Providence |
| South Carolina | Columbia |
| South Dakota | Pierre |
| Tennessee | Nashville |
| Texas | Austin |
| Utah | Salt Lake City |
| Vermont | Montpelier |
| Virginia | Richmond |
| Washington | Olympia |
| West Virginia | Charleston |
| Wisconsin | Madison |
| Wyoming | Cheyenne |

Each player is dealt five cards. Each player in turn picks a card from the draw pile that is used to match the state and capitals. Players throw out a card after picking a card if they don't need it (one card from the draw pile or their hand). Once a match is obtained the player, during his/her turn, must announce the state and capital while discarding the matched cards. The matched cards are discarded until all cards are discarded. The first player to discard all cards wins.

TRUTH FACT MATCH

The deck contains 92 game cards with the words TRUTH FACT MATCH imprinted in a bold font on the front side and the back side imprinted as follows:

46 Playing Cards with a name or a fact about African history imprinted in center of card in bold print (matching facts listed on the bottom in fine print)

46 Playing Cards with a matching fact imprinted in center of card in bold print (a name or a fact about African history listed on the bottom in fine print)

TRUTH FACT MATCH may be played by both adults and children as young as the age of six years with 2–6 players. The object of the game is to be the first player to get rid of all cards in players hand.

The play of the game is as follows:

Each player is dealt five cards. Each player in turn picks a card from the draw pile that is used to match the a name or a fact about African history. Players throw out a card after picking a card if they don't need it (one card from the draw pile or their hand). Once a match is obtained the matched cards are discarded until all cards are discarded. The first player to discard all cards wins.

The name or historical fact about African history is selected from the following:

| NAME/FACT | MATCHING FACT | MATCHING FACT |
|---|---|---|
| Africa | Cradle Of Civilization | Second Largest Continent |
| Imhotep | Created The Step Pyramids | The Father of Medicine |
| Hieroglyphics | Egyptian Writings That Used Pictures | Communication |
| Ankh | The Symbol of Life | |
| God | Amon-Ra (One Creator) | |
| Religion | Began In Africa | /Africans Believed In One God |
| Kings/Pharaohs | Ramses, Tutankhamon, Akhenaten, Thutmose III | |
| Queens | N'Zinga, Hatshepsut, Nefertiti | |
| Great Empires | Ghana, Mali, Soghai, Kush, | |
| Maat | Comprehensive Code of Laws/ | Principles; Command-ments |
| Griot | Oral Historians | |
| Timbuktu | A City In Ancient Africa Known For Wealth and Schools | |
| African Communities | Yoruba, Zulu Nubians, Ashanti, Masai, Bantu | |
| Resources | Gold, Diamonds And Many Other Natural Resources | |
| Master Shipbuilders | Africans Built Ships And Sailed o Asia And Europe Before Columbus | |
| Invaders of Africa | Asians, Arabs, Greek, Romans And Northern Europeans | Searching for Resources |
| Goree Island | In West Africa/Off The Coast Of Senegal | Place For Slave Trade |
| Revolted | Africans Rejected Slavery | |
| Joseph Cinque | Led A Revolt Of The Ship, Amistad | Return To Africa |
| Queen Amina - Of Zaria (1588–1589) | The Elder Daughter of Bakwa Turunku | Founded Zazzau Kingdom In 1536 |
| Slave Coast - | Bordering The Bight Of Benin On The Gulf Of Guinea | Slave Exportation from 16th–19th Century |
| Auset a/k/a Isis | The Wife Of Osris | Mother OF Seth And Horus |
| Ausar a/k/a Osiris | Husband Of Isis | Father of Seth And Horus |
| Heru a/k/a Horus | Son Of Ausar And Aset | Brother Of Setyphon |
| Setyphon a/k/a-Seth | Son of Ausar And Aset | Brother of Heru |
| God Concepts | Ausar And Aset | |
| African | Ancestors To All Mankind- | |
| Khufu | King of the 4th Dynasty | Largest Pyramid Builder in Egypt |
| Hatshepsut | Reigned As A King During 18th Dynasty | |
| King Tutankhamon - | Buried In The First Tomb Discovered Undisturbed | 18th Dynasty/Known As The Boy King |
| Dynasty - | A Succession Of Rulers From The Same Family Or Ancestral Lineage | |
| Ramses II | Ruled from 1279–1212 BC | The Last Of Ancient Egypt's Great Pharaohs |
| Pharaoh | King | |
| Mummification | Preservation Of A Dead Person's Body | |

-continued

| NAME/FACT | MATCHING FACT | MATCHING FACT |
|---|---|---|
| Nandi - | Queen of Zululand (1778–1826 AD) | |
| Ancestral Worship | Priest & Priestesses Would Meditate In Order To Communicate With The Deceased To Receive Guidance And Blessings | |
| Caduceus - | The Symbol Of The Medical Profession (A Winged Staff entwined By Two Serpents) | This Insignia Was Found On Imhotep's Temples |
| TWA People | Called The Pygmies | They Created The Star Of David |
| Alkebu-Lan | Indigenous Name Meaning Land of The Spirit People | Africans |
| Africa | Name Given To The Continent By The Greeks | |
| Egyptian Science And Symbols | Designs Given To The Lincoln Memorial, Washington Monument, Obelisk - Vatican In St. Peter | |
| Martial Arts - | Egyptian Warrior Scientist Laid The Foundation For All Martial Arts | |
| Africoid Olmecs | Parent Culture of Ancient America | |
| Sphinx Of Giza - Ethiopians | Hamachis Laid the Basis for Religion | |
| Hannibal | An African Man | Conquered Spain And France in 218 BC |

AFRICAN AMERICAN INVENTORS AND INVENTIONS

The deck contains 100 game cards with the words INVENTORS AND INVENTIONS imprinted in a bold font on the front side and the back side imprinted as follows:

50 Game Cards, each game card with the name of an African American inventor imprinted in center of the game card in bold print (corresponding invention imprinted on the bottom in fine print)

50 Playing Cards with the name of an invention invented by an African American inventor imprinted in center of card in bold print (the name of the corresponding inventor imprinted on the bottom of the game card in fine print)

INVENTORS AND INVENTIONS may be played by both adults and children as young as the age of six years with 2–10 players. The object of the game is to be the first player to get rid of all cards in players hand.

The play of the game is as follows:

Each player is dealt five cards. Each player in turn picks a card from the draw pile that is used to match an inventor or an invention. Players throw out a card after picking a card if they don't need it (one card from the draw pile or their hand). Once a match is obtained the matched cards are discarded until all cards are discarded. The first player to discard all cards wins.

The inventor and invention are selected from the following:

| Inventor | Invention | Date |
|---|---|---|
| Imhotep | Stethoscope/The father of Medicine | Ancient Egypt |
| Paul B. Downing | Mailbox | October 27, 1891 |
| J. L. Love | Pencil Sharpener | Nov. 23, 1897 |
| J. Standard | Refrigerator | July 14, 1891 |
| W. A. Martin | Lock | July 23, 1889 |
| Burridge & Marshman | Typewriter | April 7, 1885 |
| Granville T. Woods | Telephone Transmitter | December 2, 1884 |
| Thomas Stewart | Mop | June 11, 1893 |
| Garrett Morgan | Traffic Light/Gas Mask | Nov. 20, 1923<br>Oct. 13, 1914 |
| Lewis Latimer | Carbon Filaments/Electric Bulb | Approx. 1882 |
| Sarah Boone | Ironing Board | Dec. 30, 1887 |
| Charles Drew | Blood Plasma Bag | Approx. 1945 |
| T. Elkin | Chamber Commode | January 8, 1897 |
| W. B. Purvis | Fountain Pen | Jan 17, 1890 |
| Lydia D. Newman | Hair Brush | Nov. 15, 1898 |
| Michael C. Harvey | Lantern | August 19, 1884 |
| Alexander Miles | Elevator | Oct. 11, 1867 |
| I. R. Johnson | Bicycle Frame | Oct. 10, 1899 |
| J. Ricks | Horseshoe | March 30, 1886 |
| Edmond Berger | Spark Plug | Feb. 2, 1839 |
| Benjamin Banneker | Almanac | Approx. 1791 |
| Lawrence P. Ray | Dust Pan | August 3, 1897 |
| James Robinson | Lunch Pail | Approx. 1887 |
| S. R. Scratton | Curtain Rod | Nov. 30, 1889 |
| G. T. Sampson | Clothes Dryer | June 6, 1892 |
| Joan Clark | Medicine Tray | April 1, 1986 |
| M. A. Cherry | Tricycle | May 8, 1888 |
| George W. Carver | Peanuts/Sweet potatoes | Approx. 1896 |
| John W. Reed | Rolling Pen | Approx. 1884 |
| Brody & Surgwar | Folding Chair | June 11, 1889 |
| Joseph N. Jackson | Programmable TV Remote | March 28, 1978 |
| W. H. Richardson | Baby Buggy | June 18, 1899 |
| F. J. Loudin | Key Chain | January 9, 1894 |
| T. A. Carrington | Stove | July 25, 1876 |
| J. W. Winters | Fire Escape Ladder | May 7, 1878 |
| J. A. Burr | Lawn Mower | May 19, 1889 |
| O. Dorsey | Door Knob | Dec. 10, 1878 |
| J. Thomas White | Lemon Squeezer | December 8, 1896 |
| Frederick Jones | Thermostat Control | February 23, 1960 |
| C. O. Baliff | Shampoo Headrest | October 11, 1898 |
| O. Dorsey | Door Stop | Dec. 10, 1878 |
| T. J. Marshall | Fire Extinguisher | October 26, 1872 |
| Al Cralle | Ice Cream Scoop | February 2, 1897 |
| August Jackson | Ice Cream | Approx. 1832 |
| Joseph Dickinson | Record Arm Player | January 8, 1918 |
| Madame C. J. Walker | Hair Products | Approx. 1905 |
| Ruane Jeter | Digital Toaster | April 14, 1987 |
| Richard B. Spikes | Automatic Gear Shift | February 6, 1932 |
| W. D. Davis | Riding Saddle | October 6, 1896 |
| Willie Johnson | Egg Beater | February 5, 1884 |

AFRICAN COUNTRIES AND CAPITALS

The deck contains 106 game cards with the words AFRICAN NATIONS AND CAPITALS imprinted in a bold font on the front side and the back side imprinted as follows:

53 Playing Cards with the name of an African Nation imprinted in center of card in bold print (a corresponding capital listed on the bottom in fine print)

53 Playing Cards with the name of an African Nation's capital imprinted in center of card in bold print (the name of an African Nation listed on the bottom in fine print)

AFRICAN NATIONS may be played by both adults and children as young as the age of six years with 2–10 players. The object of the game is to be the first player to get rid of all cards in players hand.

The play of the game is as follows:

Each player is dealt five cards. Each player in turn picks a card from the draw pile that is used to match the African Nation and Capital. Players throw out a card after picking a card if they don't need it (one card from the draw pile or their hand). Once a match is obtained the matched cards are discarded until all cards are discarded. The first player to discard all cards wins.

The name African Nations and Capitals are selected from the group consisting of the following:

| NATION | CAPITAL |
|---|---|
| Algeria | Algiers |
| Angola | Luanda |
| Benin | Porto Novo |
| Botswana | Gaborone |
| Burkina Faso | Ouagadougou |
| Burundi | Bujumbura |
| Cameroon | Yaounde |
| Cape Verde | Praia |
| Central Afr. Repub. | Bangui |
| Chad | N'djamena |
| Comoros | Moroni |
| Congo | Brazzaville |
| Cote D'Ivoire | Abidjan |
| Djibouti | Djibouti |
| Egypt | Cairo |
| Equatorial Guinea | Malabo |
| Eritrea | Asmara |
| Ethiopia | Addis Ababa |
| Gabon | Libreville |
| Gambia | Banjul |
| Ghana | Accra |
| Guinea | Conakry |
| Guinea-Bissau | Bissau |
| Kenya | Nairobi |
| Lesotho | Maseru |
| Liberia | Monrovia |
| Libya | Tripoli |
| Madagascar | Antananarivo |
| Malawi | Lilongue |
| Mali | Bamako |
| Mauritania | Nouakchott |
| Mauritius | Port Louis |
| Morocco | Rabat |
| Mozambique | Maputo |
| Namibia | Windhoek |
| Niger | Niamey |
| Nigeria | Abuja |
| Rwanda | Kigali |
| Sao Tome & Principe | Sao Tome |
| Senegal | Dakar |
| Seychelles | Victoria |
| Sierra Leone | Freetown |
| Somalia | Mogadishu |
| South Africa | Pretoria |
| Sudan | Khartoum |
| Swaziland | Mbane |
| Tanzania | Dar-es-Salaam |
| Togo | Lome |
| Tunisia | Tunis |
| Uganda | Kampala |
| Zaire | Kinshasa |
| Zambia | Lusaka |
| Zimbabwe | Harare |

WELLNESS MATCH

The deck contains 90 game cards with the words WELLNESS MATCH imprinted in a bold font on the front side and the back side imprinted as follows:

45 Playing Cards with the name of a Wellness Match Term imprinted in center of card in bold print (a corresponding wellness match fact listed on the bottom in fine Print)

45 Playing cards with the name of a Wellness Match Fact imprinted in center of card in bold print (a corresponding wellness match term listed on the bottom in fine print)

WELLNESS MATCH may be played by both adults and children as young as the age of nine years with 2–6 players. The object of the game is to be the first player to get rid of all cards in player's hand.

The play of the game is as follows:

Each player is dealt five cards. Each player in turn picks a card from the draw pile that is used to match the Wellness Term of Fact. Players throw out card after picking a card if they don't need it (One card from the draw pile or their hand). Once a match is obtained, the matches are stated and discarded, until all cards are discarded. The first player to discard all cards wins.

Wellness Match Terms and Facts are selected from the group consisting of the following:

WELLNESS MATCH—Ages 9—Adult

1. Herbs Help The Body To Heal Itself/Medicine Removes The Symptoms.
2. Muscles, Stamina, And Energy Are Built By Exercise.
3. Good Health Is Natural And Simple.
4. Causes Of Disease: Toxicity, Timing And Thoughts.
5. Healing Starts From The Intemal(Inside) To External (Out).
6. A Cold Is A Sign That The Body Is Detoxifying Itself.
7. Healing—In We Go To Mend, Out We Come Healthy Again.
8. Pure Water—Drink 1-Oz Of Pure Water/To Every 2lbs. Of Body Weight. (Divide Your Weight By 2) or 1 gallon if possible.
9. Protein—Nutritional Need is 20–50 Grams or Less Per Day 3–4 times per week.
10. A Weakened Immune System Is A Welcome Sign For Germs And Diseases.
11. Phony Foods Are Processed/Refined Foods That Inhibit Health/Whole Foods=Natural And Raw.
12. Negative Thoughts/Energy Generate Acid-Acid Generator.
13. Toxins Are Produced From High Protein Foods Such As Meat, Dairy And Grains.
14. New Start=Nutrition, Exercise, Water, Sunshine, Temperance, Air(Fresh), Rest And Trust In The Divine.
15. Fruits And Vegetables Are Alkaline Producers.
16. Meat, Poultry, Fish, Seeds, Nuts And Grains Are Acid Producers.
17. Alkaline Balances Acid.
18. Food Pyramid Servings: Fruits—2, Vegetables—3–5, Whole Grains 6–11, Protein/Beans/Nut, Seeds And Meat/Alternatives 2–3.
19. Food Pyramid Servings: Dairy/Soy/Rice & Other Fortified Alternatives 2–3, Fats, Oils, Sweets—Eat Sparingly.
20. Herbivores Eat Only Plants, Carnivores Eat Meat And Fish.
21. Charkras The Seven Centers Of Spiritual Energy In The Human Body=Sanskrit/Hindi.
22. Love=Unconditional=Love For Creator, Self, And Others.
23. Wellness=Positive Thoughts, Good Nutrition, Exercise, Rest Fresh Air, Pure Water And Proper Elimination.
24. Shoo Negative Thoughts Away, Invite Positive Thoughts.
25. Balance In Relationships-Forgiveness And Reconciliation.
26. Whirm=Warmth, Honesty, Integrity, Responsibility, Mutuality.
27. Smiles And Proper Attitude Per Day Keep The Doctor Away.

28. pH-Potential Of Hydrogen—Measure The Relative Acidity Or Alkalinity Of A Solution Also How Healthy You Are.
29. pH Measure—0.00 To 14.00—7.00 Is Neutral.
30. Acid Scale—0–6.
31. Alkaline Scale—8.00–14.
32. 3 Sources Of Acid-Fruits, Cellular Activity And Acid-Producing Foods.
33. Body Fluids Are Measured By pH.
34. How Do We Nourish Our Cells? The Food We Eat Nourishes Our Cells.
35. Begin The Day With Exercise And Breakfast.
36. What Goes In Must Come Out—Proper Bowel/Urine Eliminations, Enemas And Colonics.
37. Fasting—To Eat Small Amounts Of Raw Foods Or Abstain From Food.
38. Proper Skin Cleansing: Brushing, Baths, Saunas And Sweat Lodges.
39. Aromatherapy—The Essential Use Of Oils, Fragrances, Substances, Lotions And Inhalants In An Effort To Affect Mood And Promote Health.
40. Pampering—Is A Unique Distinction Of Restoring The Inner Self; It Transforms Your Mind, Body, Spirit And Infuses Your Life With More Joy.
41. Massage–Rubbing Or Kneading Parts Of The Body To Aid Circulation Or Relax The Muscles.
42. Reflexology—The Application Of Finger Pressure, Especially To The Feet Using A Massage Method That Relieves Nervous Tension.
43. Health Is Wealth—Live The Best Life Possible.
44. Know Thyself—Oneness (Spiritual Connectedness) With The Creator.
45. Proper Cooking/Eating Utensils—Stainless Steel, Glass, Cast Iron.

All of the games may optionally be played in conjunction with a game board. The game board will have spaces for the draw pile, discard pile and an area for the card in play.

Changes and modifications in the specifically described embodiments can be carried out without departing from the scope of the invention.

What is claimed is:

1. An educational card game comprising:

a plurality of game cards, each of said cards having a front side and a back side, the front side having subject matter information printed thereon and the back side having corresponding factual information relating to the front side of same card, wherein, on the back side, half of the total number of cards have a name, of a name or fact in the center of the card, and a name of a corresponding matching fact in the lower right hand corner, and, on the back side, the other half of the total number of cards have a matching fact in the center, and a name or fact in the lower right hand corner.

2. The card game of claim 1 wherein there are 100 game cards with the words STATES & CAPITALS imprinted on the front side.

3. The card game of claim 2 wherein 50 of the game cards are imprinted on the back side with a name of a state capital in center of card in boid print and in lower right hand corner a name of a corresponding state and 50 game cards are imprinted on the back side thereof with the name of a state in center of card in bold print and in a lower right hand corner a name of a corresponding state capital.

4. The card game of claim 3 wherein the front side of the game card further includes a pictorial representation of a U.S. map outlining the states.

5. The card game of claim 4 wherein the back side the game card further includes a pictorial representation of an outline of a state with the capital optionally highlighted in said pictorial representation.

6. The card game of claim 1 wherein there are 100 game cards with the words INVENTORS & INVENTIONS imprinted on the front side.

7. The card game of claim 6 wherein 50 of the game cards are imprinted on the back side with a name of an inventor in center of card in bold print and in lower right hand comer a name of a corresponding invention and date of invention and 50 game cards are imprinted on the back side thereof with an invention and date of invention in center of card in bold print and in a lower right hand corner a name of a inventor.

8. The card game of claim 7 wherein the front side of the game card further includes a pictorial representation of an invention.

9. The card game of claim 8 wherein the back side the game card further includes a pictorial representation of an invention.

10. The card game of claim 1 wherein there are 92 game cards with the words TRUTH FACT MATCH imprinted on the front side.

11. The card game of claim 10 wherein 46 of the game cards are imprinted on the back side with a name of a name or fact in center of card in bold print and in lower right hand corner a name of a corresponding matching fact and 46 game cards are imprinted on the back side thereof with a matching fact in center of card in bold print and in a lower right hand corner a name or fact.

12. The card game of claim 1 wherein there are 106 game cards with the words AFRICAN NATIONS & CAPITALS imprinted on the front side.

13. The card game of claim 12 wherein 53 of the game cards are imprinted on the back side with a name of an African Nation in center of card in bold print and in lower right hand corner a name of a corresponding Capital and 53 game cards are imprinted on the back side thereof with a Capital in center of card in bold print and in a lower right hand corner a name of a corresponding African Nation.

14. The card game of claim 13 wherein the front side of the game card further includes a pictorial representation of an African map outlining the nations.

15. The card game of claim 14 wherein the back side of the game card further includes a pictorial representation of an outline of an African Nation with the capital optionally highlighted in said pictorial representation.

16. The card game of claim 1 wherein the game cards further include a pictorial representation of the subject matter imprinted on the front side and optionally on the back side.

17. The card game of claim 1 wherein there are 90 game cards with the words WELLNESS MATCH imprinted on the front side.

18. The card game of claim 1 wherein 45 of the game cards are imprinted on the back side with a name of a Wellness Match Term in center of card in bold print and in lower right hand corner a name of a corresponding Wellness Match Fact and 45 game cards are imprinted on the back side thereof. with the name of a Wellness Match Fact in center of card in bold print and in a lower right hand corner a name of a corresponding Wellness Match Term.

* * * * *